US010271138B2

(12) United States Patent
Gao et al.

(10) Patent No.: US 10,271,138 B2
(45) Date of Patent: Apr. 23, 2019

(54) METHOD AND DEVICE FOR COMPENSATING FREQUENCY RESPONSE OF AUDIO SIGNAL

(71) Applicant: SHENZHEN TCL DIGITAL TECHNOLOGY LTD., Shenzhen, Guangdong (CN)

(72) Inventors: Weibiao Gao, Guangdong (CN); Shenglin Zhu, Guangdong (CN)

(73) Assignee: SHENZHEN TCL DIGITAL TECHNOLOGY LTD., Shenzhen (CN)

( * ) Notice: Subject to any disclaimer, the term of this patent is extended or adjusted under 35 U.S.C. 154(b) by 0 days.

(21) Appl. No.: 16/067,580

(22) PCT Filed: Jun. 3, 2016

(86) PCT No.: PCT/CN2016/084714
§ 371 (c)(1),
(2) Date: Jun. 29, 2018

(87) PCT Pub. No.: WO2017/113607
PCT Pub. Date: Jul. 6, 2017

(65) Prior Publication Data

US 2019/0014412 A1 Jan. 10, 2019

(30) Foreign Application Priority Data

Dec. 31, 2015 (CN) ..... 2015 1 1028629

(51) Int. Cl.
*H04R 3/04* (2006.01)

(52) U.S. Cl.
CPC ..... *H04R 3/04* (2013.01)

(58) Field of Classification Search
CPC ..... H04R 3/04
(Continued)

(56) References Cited

U.S. PATENT DOCUMENTS 9,148,725 B2 9/2015 Gupta et al.
2014/0266454 A1* 9/2014 Testi ..... H03G 3/008 330/284

FOREIGN PATENT DOCUMENTS

CN 102447992 5/2012
CN 103473005 12/2013
CN 103716269 4/2014

OTHER PUBLICATIONS

Office Action dated Mar. 8, 2018 from corresponding application No. CN 201511028629.8.

(Continued)

*Primary Examiner* — Paul Kim
(74) *Attorney, Agent, or Firm* — Hauptman Ham, LLP

(57) ABSTRACT

The present disclosure provides a method for compensating frequency response of audio signal, the method includes: presetting n groups of audio signals with different frequencies, acquiring the minimum signal amplitude value heard by user in each group of audio signals; calculating by a preset gain algorithm to acquire corresponding compensation gain, according to the minimum signal amplitude value; for each group of audio signals, calculating by a preset filtering coefficient algorithm to acquire a corresponding filtering coefficient, according to the frequency of the audio signal, the compensation gain and a preset quality factor; generating a frequency response compensation curve of audio signal according to the filtering coefficient corresponding to the n groups of audio signals; and adjusting an acoustic frequency response of the audio signal according to the compensation curve, and outputting the adjusted audio signal. The present disclosure further provides a device for compensating frequency response of audio signal.

14 Claims, 4 Drawing Sheets

(58) Field of Classification Search
USPC ..... 381/98
See application file for complete search history.

(56) References Cited

OTHER PUBLICATIONS

International search report dated Sep. 21, 2016 from corresponding application No. PCT/CN2016/084714.

* cited by examiner

METHOD AND DEVICE FOR COMPENSATING FREQUENCY RESPONSE OF AUDIO SIGNAL

RELATED APPLICATIONS

The present application is a National Phase of International Application Number PCT/CN2016/084714, filed Jun. 3, 2016, and claims the priority of China Application No. 201511028629.8, filed Dec. 31, 2015.

FIELD

This disclosure generally relates to the technical field of audio signal processing, and more particularly relates to a method and a device for compensating frequency response of audio signal.

BACKGROUND

In a design process of an audio player, the frequency response of the audio signal is commonly needed to be adjusted to compensate the frequency response of the speaker as the frequency response curve of the speaker is uneven, to achieve a much flatter frequency response, and a better sound quality.

Normally, the adjusting process is conducted in an anechoic room (a room without sound reflection), so that it is just in the anechoic room the frequency response characteristic obtained is flat. However, actually in user's rooms, as the walls and the household products may absorb, diffract, and reflect the sound waves (different affecting to sound waves having different frequencies), the frequency response characteristic which is flat during in the anechoic room, would be uneven during in user's rooms. In addition, the above adjusting method only compensates the unevenness of the speaker, but cannot compensate the uneven frequency response characteristic of human's ears (human ears' equal-loudness contour reflects the characteristic), as different people have different equal-loudness contours (race, gender, and age can induce the difference). Therefore, the sound response characteristics of the speaker obtained by user after being adjusted through the above method are still not flat enough, thus causing the sound being still unsatisfactory.

SUMMARY

It is therefore one main object of this disclosure to provide a method and a device for compensating frequency response of audio signal, aiming to solve the technical problem of that sound loudness response curve obtained by user is uneven in actual use.

In order to achieve the above object, the method for compensating frequency response of audio signal proposed by this disclosure includes the following operations.

n groups of audio signals with different frequencies are preset, the minimum signal amplitude value which can be heard by user in each group of audio signals is acquired. The n groups of audio signals with different frequencies are n groups of single frequency sinusoidal signals with different frequencies, each group of audio signals is composed of single frequency sinusoidal signals whose amplitude values are arranged from small to large;

a corresponding compensation gain is calculated by a preset gain algorithm to acquire, according to the minimum signal amplitude value;

for each group of audio signals, a corresponding filtering coefficient is calculated by a preset filtering coefficient algorithm, according to the frequency of the audio signal, the compensation gain, and a preset quality factor;

a filter coefficient of corresponding filter is adjusted, according to the filtering coefficient corresponding to the n groups of audio signals;

a frequency response compensation curve of audio signal is generated according to a filter group which is composed of the n filters;

the section in the compensation curve which is lower than a preset frequency is acquired to generate a low loudness compensation curve; and an acoustic frequency response of the audio signal is adjusted according to the low loudness compensation curve, and the adjusted audio signal is outputted.

Preferably, after the step of adjusting an acoustic frequency response of the audio signal according to the low loudness compensation curve, outputting the adjusted audio signal, the method further includes:

the root mean square value of the signal amplitude of the adjusted audio signal is acquired;

when it is determined that the root mean square value of the signal amplitude is larger than a preset threshold value, the section in the compensation curve which is higher than the preset frequency is acquired to generate a high loudness compensation curve; and the acoustic frequency response of the audio signal is adjusted according to the high loudness compensation curve, and the adjusted audio signal is outputted.

In addition, in order to achieve the above object, the present disclosure also provides a method for compensating frequency response of audio signal, which includes:

n groups of audio signals with different frequencies are preset, the minimum signal amplitude value which can be heard by user in each group of audio signals is acquired;

a corresponding compensation gain is calculated by a preset gain algorithm to acquire, according to the minimum signal amplitude value;

for each group of audio signals, a corresponding filtering coefficient is calculated by a preset filtering coefficient algorithm, according to the frequency of the audio signal, the compensation gain and a preset quality factor;

a frequency response compensation curve of audio signal is generated according to the filtering coefficient corresponding to the n groups of audio signals; and an acoustic frequency response of the audio signal is adjusted according to the compensation curve, and the adjusted audio signal is outputted.

Preferably, the n groups of audio signals with different frequencies are n groups of single frequency sinusoidal signals with different frequencies, each group of audio signals is composed of single frequency sinusoidal signals whose amplitude values are arranged from small to large.

Preferably, the step of generating the frequency response compensation curve of audio signal according to the filtering coefficient corresponding to the n groups of audio signals includes:

a filter coefficient of corresponding filter is adjusted, according to the filtering coefficient corresponding to the n groups of audio signals; and a frequency response compensation curve of audio signal is generated according to a filter group composed of the n filters.

Preferably, the step of adjusting the acoustic frequency response of the audio signal according to the compensation curve, and outputting the adjusted audio signal includes:

the section in the compensation curve which is lower than a preset frequency is acquired, to generate a low loudness compensation curve; and the acoustic frequency response of the audio signal is adjusted according to the low loudness compensation curve, and the adjusted audio signal is outputted.

Preferably, after the step of adjusting the acoustic frequency response of the audio signal according to the low loudness compensation curve, and outputting the adjusted audio signal, the method further includes:

the root mean square value of the signal amplitude of the adjusted audio signal is acquired;

when it is determined that the root mean square value of the signal amplitude is larger than a preset threshold value, the section in the compensation curve which is higher than the preset frequency is acquired, to generate a high loudness compensation curve; and the acoustic frequency response of the audio signal is adjusted according to the high loudness compensation curve, and the adjusted audio signal is outputted.

In addition, in order to achieve the above object, the present disclosure also provides a device for compensating frequency response of audio signal, which includes:

a minimum amplitude acquiring module, configured to preset n groups of audio signals with different frequencies, and acquire the minimum signal amplitude value heard by user in each group of audio signals;

a compensation gain acquiring module, configured to calculate by a preset gain algorithm to acquire corresponding compensation gain, according to the minimum signal amplitude value;

a filtering coefficient acquiring module, configured to calculate by a preset filtering coefficient algorithm to acquire a corresponding filtering coefficient for each group of audio signals, according to the frequency of the audio signal, the compensation gain, and a preset quality factor;

a compensation curve generating module, configured to generate a frequency response compensation curve of audio signal according to the filtering coefficient corresponding to the n groups of audio signals; and a frequency response adjusting module, configured to adjust an acoustic frequency response of the audio signal according to the compensation curve, and outputting the adjusted audio signal.

Preferably, the n groups of audio signals with different frequencies are n groups of single frequency sinusoidal signals with different frequencies, each group of audio signals is composed of single frequency sinusoidal signals whose amplitude values are arranged from small to large.

Preferably, the compensation curve generating module includes:

a filter adjusting unit, configured to adjust filter coefficient of corresponding filter, according to the filtering coefficient corresponding to the n groups of audio signals; and a filter group unit, configured to generate a frequency response compensation curve of audio signal according to a filter group composed of the n filters.

Preferably, the frequency response adjusting module includes:

a low loudness compensation curve acquiring unit, configured to acquiring section in the compensation curve which is lower than a preset frequency, to generate a low loudness compensation curve; and a low loudness compensating unit, configured to adjust the acoustic frequency response of the audio signal according to the low loudness compensation curve, and output the adjusted audio signal.

Preferably, the frequency response adjusting module further includes:

a signal amplitude acquiring unit, configured to acquire the root mean square value of the signal amplitude of the adjusted audio signal;

a high loudness compensation curve acquiring unit, configured to acquire section in the compensation curve which is higher than the preset frequency, to generate a high loudness compensation curve, when it is determined that the root mean square value of the signal amplitude is larger than a preset threshold value; and a high loudness compensating unit, configured to adjust the acoustic frequency response of the audio signal according to the high loudness compensation curve, and output the adjusted audio signal.

The exemplary embodiment of the present disclosure provides a method and a device for compensating frequency response of audio signal, the audio signal can be adjusted according to the characteristic of human ear and the current environment, so as to realize that when the audio player is in actual use, the speaker can output the flat sound loudness response curve, further bringing user a better sound quality.

Various implementations, functional features, and advantages of this disclosure will now be described in further detail in connection with some illustrative embodiments and the accompanying drawings.

DETAILED DESCRIPTION OF THE EMBODIMENTS

It is to be understood that, the described embodiments are only some exemplary embodiments of the present disclosure, and the present disclosure is not limited to such embodiments.

The main technical solution of the exemplary embodiment is: presetting n groups of audio signals with different frequencies, acquiring the minimum signal amplitude value heard by user in each group of audio signals; calculating by a preset gain algorithm to acquire corresponding compensation gain, according to the minimum signal amplitude value; for each group of audio signals, calculating by a preset filtering coefficient algorithm to acquire a corresponding filtering coefficient, according to the frequency of the audio signal, the compensation gain and a preset quality factor; generating a frequency response compensation curve of audio signal according to the filtering coefficient corresponding to the n groups of audio signals; and adjusting an acoustic frequency response of the audio signal according to the compensation curve, outputting the adjusted audio signal.

As in the existing technology the frequency response of the audio signal cannot be compensated according to the characteristic of user's ear and the current environment in user's actual use, causing a sound loudness response curve obtained by user is uneven.

The present disclosure provides a technical solution, which can enable the audio player compensate the frequency response of the audio signal according to the characteristic of user's ear and the current environment, as such the sound obtained by user has flat sound loudness response curve.

Figure 1:
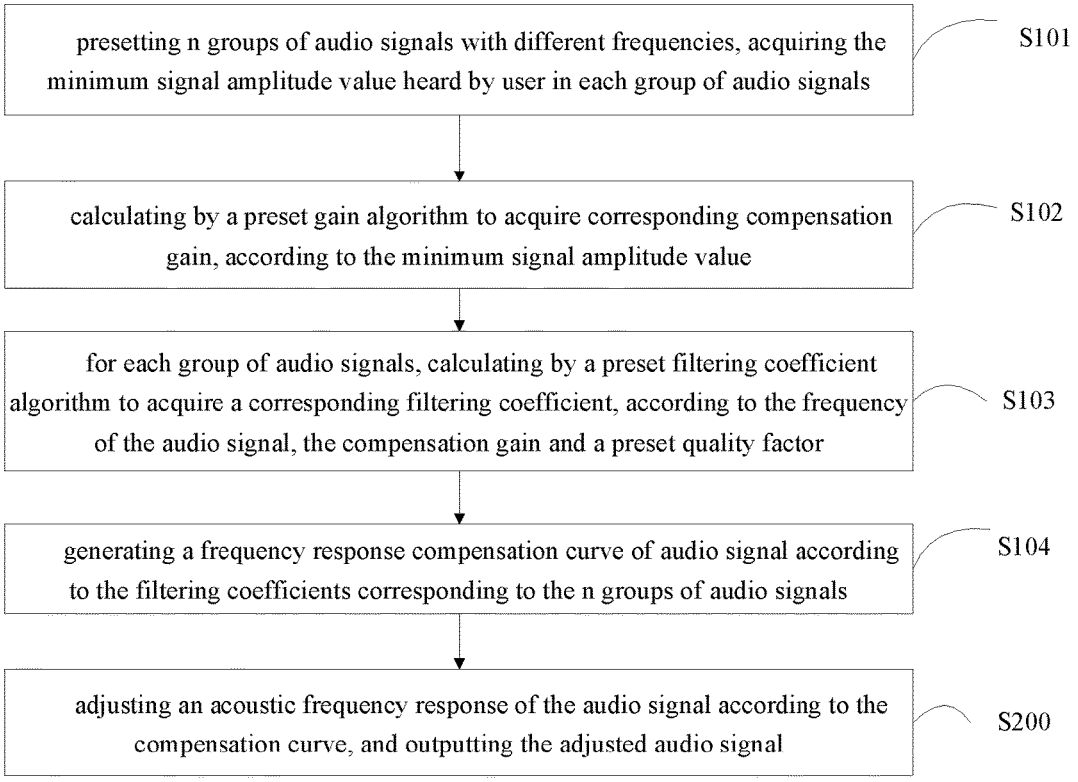
FIG. 1 is a flow chart of a method for compensating frequency response of audio signal of the present disclosure according to a first exemplary embodiment.

Referring to FIG. 1, which is a flow chart of the method for compensating frequency response of audio signal of the present disclosure according to a first exemplary embodiment, the method for compensating frequency response of audio signal includes:

Step S101, presetting n groups of audio signals with different frequencies, acquiring the minimum signal amplitude value which can be heard by user in each group of audio signals;

In the hearing range of the human ears, n groups of audio signals with different frequencies are preset, and the minimum signal amplitude value in each group of audio signals which can be heard by user is acquired, n is larger than or equal to 2. Of course, the larger the value of n is, the more the groups of audio signals with different frequencies, the finer it is adjusted, the better the effect. One preferable solution is: the audio player stores n groups of audio signals with different frequencies, the n groups of audio signals with different frequencies are n groups of single frequency sinusoidal signals with different frequencies, each group of audio signals is composed of single frequency sinusoidal signals whose amplitude values are arranged from small to large. User confirms the minimum signal amplitude value which can be heard through successively broadcasting each group of audio signals.

Step S102, calculating by a preset gain algorithm to acquire corresponding compensation gain, according to the minimum signal amplitude value;

The needed compensation gain is calculated by the preset gain algorithm, according to the minimum signal amplitude value heard by user, one possible calculating method is: the minimum signal amplitude value heard by user is divided by the minimum signal amplitude corresponding to the audio signal.

Step S103, for each group of audio signals, calculating by a preset filtering coefficient algorithm to acquire a corresponding filtering coefficient, according to the frequency of the audio signal, the compensation gain, and a preset quality factor;

For each group of the signals, the corresponding filtering coefficient is calculated by the preset filtering coefficient algorithm, according to the frequency of audio signals, the compensation gain acquired by the calculating step S102, and the preset quality factor.

Step S104, generating a frequency response compensation curve of audio signal according to the filtering coefficient corresponding to the n groups of audio signals;

The frequency response compensation curve of audio signal is generated in accordance with the frequency corresponding to each group of the audio signals, according to the filtering coefficient corresponding to the n groups of audio signals, normally, the method for generating the compensation curve includes:

adjusting filter coefficient of corresponding filter, according to the filtering coefficient corresponding to the n groups of audio signals; and generating a frequency response compensation curve of audio signal according to a filter group composed of the n filters.

Step S200, adjusting an acoustic frequency response of the audio signal according to the compensation curve, and outputting the adjusted audio signal.

The acoustic frequency response of the audio signal can be adjusted through an hardware method or a or software method according to the compensation curve, as such obtaining a flat sound loudness response curve when the audio signals are outputted, further bringing user a better sound quality in the current environment.

In practice, taking the television as an example, the specific implement step of the exemplary embodiment includes the following operations.

1. the television prestores n groups of single frequency sinusoidal signals with different frequencies, which are within the hearing range of the human ear (for example, there are five groups: 100 Hz, 500 Hz, 2 kHz, 8 kHz, 15 kHz; the more the groups of audio signals, the finer it is adjusted, the better the effect), each group of the signals is composed of signals whose amplitude values arranged from small to large, and defined as Fnj, the amplitude value is defined as Anj. The amplitude values having the same serial number in different groups are the same, such as, the amplitude value of the first signal F11 in the first group is the same with the amplitude value of the first signal F21 in the second group, that is A11=A21;

2. when finished booting for the first time, the interface would note user to finish the sound quality setting on site (one option can be set in the system setting, as such user can also adjust the sound quality at any time);

3. user can enter into the setting step through controlling the remote control: click on the first group of signals to play;

4. the system calls the first group of signals (such as 100 Hz) and makes a sound according to the amplitude values arranged from small to large from the speaker, the duration time of each signal is defined as t1, the interval time of each signal is defined as t2; if the pause signal has not been received from the user, the system would continuously play the signal behind the first group of the signals.

5. user listens the sound of the first group of signals at the conventional television watching position; as the previous amplitude values are smaller, the signals with small amplitude values are inaudible to human, with the amplitude values increase, user can gradually hear the sound; when heard the sound for the first time, user presses the pause button, for confirming the minimum signal amplitude;

6. after receiving the pause signal, the system remembers the serial number F1j of the signal ongoing (the serial number corresponds to an audio signal whose frequency has a given amplitude (the unit is V));

7. user can enter into the setting step: click on the second group of signals to play;

8. the system calls the second group of signals (such as 500 Hz) and makes a sound according to the amplitude values arranged from small to large from the speaker, the duration time of each signal is defined as t1, the interval time of each signal is defined as t2; if the pause signal has not been received from the user, the system would continuously play the signal behind the second group of the signals.

Figure 2:
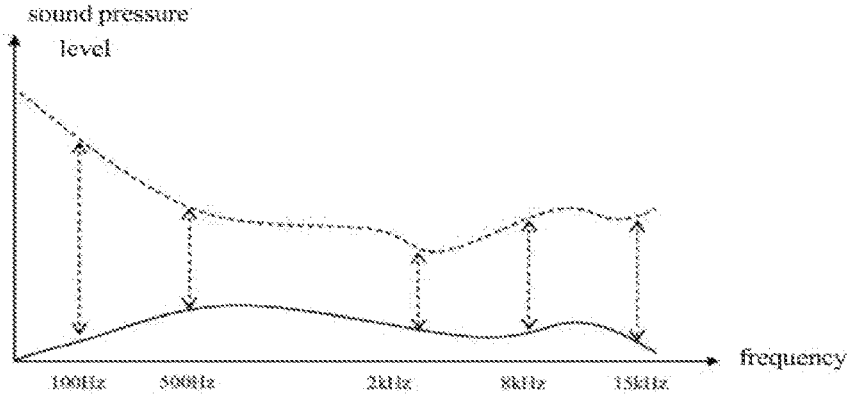
FIG. 2 is a diagram of a possible compensation curve generated in the exemplary embodiment of the method and the device for compensating frequency response of audio signal.

9. user listens the sound of the second group of signals at the conventional television watching position; as the previous amplitude values are smaller, the signals with small amplitude values are inaudible to human, with the amplitude values increase, user can gradually hear the sound; when heard the sound for the first time, user presses the pause button, for confirming the minimum signal amplitude;

10. after receiving the pause signal, the system remembers the serial number F2j of the signal ongoing (the serial number corresponds to an audio signal whose frequency has a given amplitude (the unit is V));

11. repeat steps 7-10 until the minimum signal amplitudes of the five groups of the signals which can be heard by user are acquired;

12. the signal amplitude of each group of signals which just can be heard by user is obtained according to serial number of each group of signals, and the needed compensating curve is calculated, referring to FIG. 2, the frequency response of the speaker is further compensated, to obtain the flat loudness response curve corresponding to the user, the environment, for resulting a more stereo sound quality effect, and, the quality factor is determined according to the group number of the signals, referring to Table 1.

TABLE 1

| Group number of signals | Quality factor |
|---|---|
| 5 | 3 |
| 6 | 3.5 |
| 7 | 4 |
| 8 | 4.5 |
| 9 | 5 |
| 10 | 6 |

In the exemplary embodiment, through setting the multiple groups of audio signals having different frequencies, the minimum signal amplitude which can be heard by user is acquired, and the corresponding compensation gain is calculated accordingly, and the frequency response compensation curve of audio signal is generated, finally the audio signals can be adjusted according to the generated frequency response compensation curve of audio signal, and the adjusted audio signals can be outputted, as such the audio player is more aligned with the characteristic of human ear and the current environment in which the audio player is located.

Figure 3:
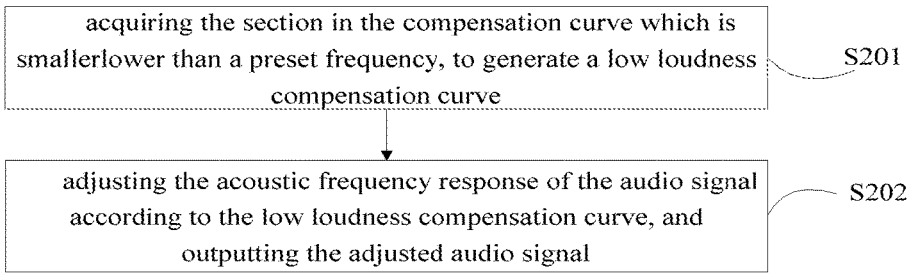
FIG. 3 is a flow chart of a method for compensating frequency response of audio signal of the present disclosure according to a second exemplary embodiment.

Furthermore, referring to FIG. 3, which is a method for compensating frequency response of audio signal of the present disclosure according to a second exemplary embodiment, based on the exemplary embodiment shown in FIG. 1, the step S200 of adjusting the acoustic frequency response of the audio signal according to the compensation curve, and outputting the adjusted audio signal, includes:

Step S201, acquiring the section in the compensation curve which is lower than a preset frequency, to generate a low loudness compensation curve;

As when the audio player outputs the audio signals, the low loudness frequency response normally needs to be compensated, therefore the section in the compensation curve which is lower than a preset frequency is acquired, and the low loudness compensation curve is generated according to the acquired section, normally, the preset frequency is 600 Hz.

Step S202, adjusting the acoustic frequency response of the audio signal according to the low loudness compensation curve, and outputting the adjusted audio signal.

The acoustic frequency response of low frequency part of the audio signal is adjusted according to the low loudness compensation curve, and the adjusted audio signal is outputted, such outputting a flatter sound loudness response curve when the audio signals are outputted, further bringing user a better sound quality in the current environment.

In the exemplary embodiment, based on the advantages of the previous exemplary embodiment, the low frequency part of the audio signals is conducted with the frequency response compensation in the exemplary embodiment, which solves the problem of that the frequency response of the low frequency signal is not enough when outputting the audio signals.

Figure 4:
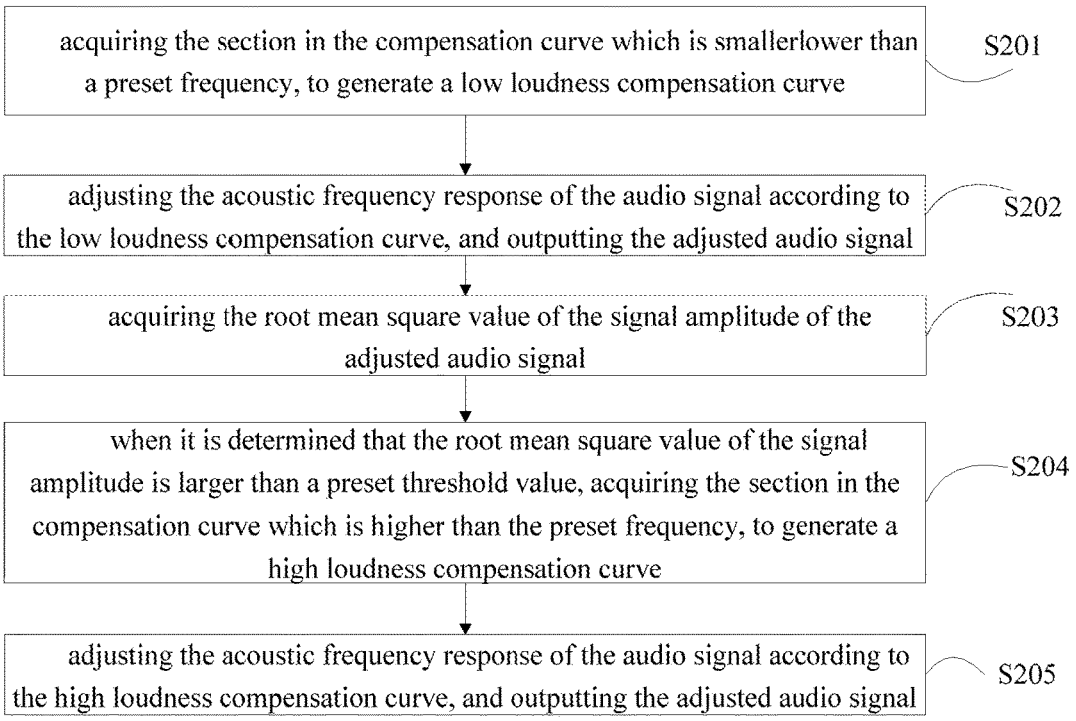
FIG. 4 is a flow chart of a method for compensating frequency response of audio signal of the present disclosure according to a third exemplary embodiment.

Furthermore, referring to FIG. 4, which is a method for compensating frequency response of audio signal of the present disclosure according to a third exemplary embodiment, based on the exemplary embodiment shown in FIG. 3, after the step S202 of adjusting the acoustic frequency response of the audio signal according to the low loudness compensation curve, and outputting the adjusted audio signal, further includes:

Step S203, acquiring the root mean square value of the signal amplitude of the adjusted audio signal;

The adjusted audio signal is sampled in real time, the root mean square value of the adjusted signal amplitude is calculated according to the sampling result.

For this step, one possible embodiment includes:

1. each audio signal amplitude with a time period of T is sampled. For example, the sampling rate F is 48 k, and the number of sampling points is 48 k*T. Taking T=200 ms as an example, the number of sampling points=48 k*0.2=9600;

2. the root mean square value of the signal with the starting point of t (that is the $t^{th}$ point, it amplitude is marked as F), the time period of T, is calculated in real time:

$$x = \frac{1}{F*T}\sqrt{\sum_{i=t+(F*T-1)}^{i=t} x_i^2}$$

Step S204, when it is determined that the root mean square value of the signal amplitude is larger than a preset threshold value, acquiring the section in the compensation curve which is higher than the preset frequency, to generate a high loudness compensation curve;

Whether the root mean square value of the signal amplitude is larger than the preset threshold value is determined, when the root mean square value of the signal amplitude is larger than the preset threshold value, the section in the compensation curve which is higher than the preset frequency is acquired, and the high loudness compensation curve is generated, commonly, the preset frequency is 600 Hz, in practice, a second order high pass filter can be adopted, the cutoff frequency of the second order high pass filter is the preset frequency.

Step S205, adjusting the acoustic frequency response of the audio signal according to the high loudness compensation curve, and outputting the adjusted audio signal.

The acoustic frequency response of high frequency part of the audio signal is adjusted according to the high loudness compensation curve, and the adjusted audio signal is outputted, such outputting a flatter sound loudness response curve when the audio signals are outputted, further bringing user a better sound quality in the current environment.

In the exemplary embodiment, based on the advantages of the previous exemplary embodiment, the low frequency part of the audio signal is conducted with the frequency response compensation in the exemplary embodiment, and the root mean square value of the signal amplitude of the compensated audio signal is determined at the same time, when it is bigger than the preset threshold value, the high frequency part of the audio signal is conducted with frequency response compensation, as such obtaining a flatter sound loudness response curve, further bringing user a better sound quality in the current environment.

Figure 5:
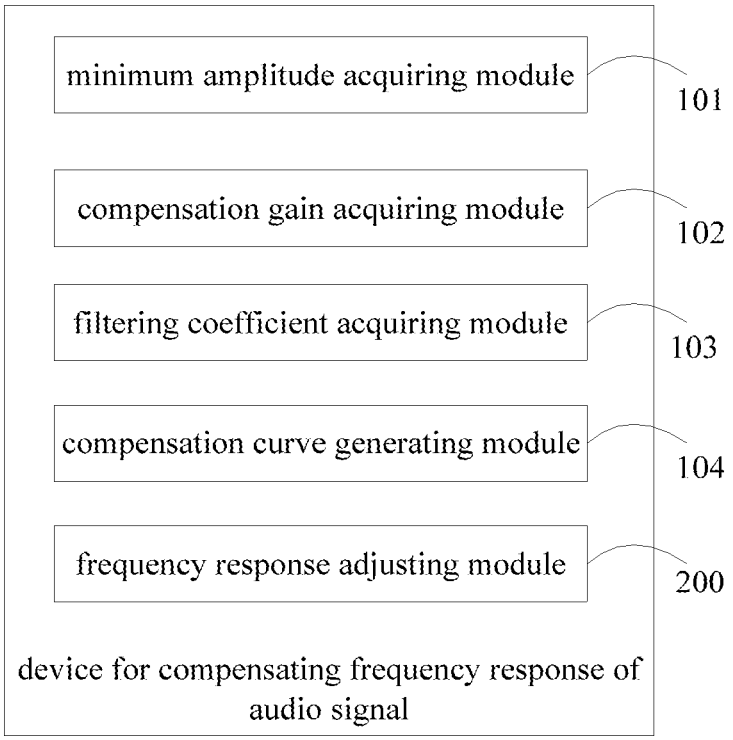
FIG. 5 is a functional module diagram of a device for compensating frequency response of audio signal of the present disclosure according to a first exemplary embodiment.

Referring to FIG. 5, which shows a device for compensating frequency response of audio signal of the present disclosure according to a first exemplary embodiment, the device for compensating frequency response of audio signal includes:

a minimum amplitude acquiring module 101, configured to preset n groups of audio signals with different frequencies, and acquire the minimum signal amplitude value heard by user in each group of audio signals;

In the hearing range of the human ears, n groups of audio signals with different frequencies are preset, and the minimum signal amplitude value in each group of audio signals which can be heard by user is acquired, n is larger than or equal to 2. Of course, the larger the value of n is, the more the groups of audio signals with different frequencies, the finer it is adjusted, the better the effect. One preferable solution is: the audio player stores n groups of audio signals with different frequencies, the n groups of audio signals with different frequencies are n groups of single frequency sinusoidal signals with different frequencies, each group of audio signals is composed of single frequency sinusoidal signals whose amplitude values are arranged from small to large. User confirms the minimum signal amplitude value which can be heard through successively broadcasting each group of audio signals.

a compensation gain acquiring module 102, configured to calculate by a preset gain algorithm to acquire corresponding compensation gain, according to the minimum signal amplitude value;

The needed compensation gain is calculated by the preset gain algorithm, according to the minimum signal amplitude value heard by user, one possible calculating method is: the minimum signal amplitude value heard by user is divided by the minimum signal amplitude corresponding to the audio signal.

a filtering coefficient acquiring module 103, configured to calculate by a preset filtering coefficient algorithm to acquire a corresponding filtering coefficient for each group of audio signals, according to the frequency of the audio signal, the compensation gain and a preset quality factor;

For each group of the signals, the corresponding filtering coefficient is calculated by the preset filtering coefficient algorithm, according to the frequency of audio signals, the compensation gain acquired by the calculating step S102, and the preset quality factor.

a compensation curve generating module 104, configured to generate an frequency response compensation curve of audio signal according to the filtering coefficient corresponding to the n groups of audio signals;

The frequency response compensation curve of audio signal is generated in accordance with the frequency corresponding to each group of the audio signals, according to the filtering coefficient corresponding to the n groups of audio signals, normally, the method for generating the compensation curve includes:

the filter coefficient of corresponding filter is adjusted according to the filtering coefficient corresponding to the n groups of audio signals; and the frequency response compensation curve of audio signal is generated according to a filter group composed of the n filters.

a frequency response adjusting module 200, configured to adjust an acoustic frequency response of the audio signal according to the compensation curve, and output the adjusted audio signal.

The acoustic frequency response of the audio signal can be adjusted through an hardware method or a or software method according to the compensation curve, such outputting a flat sound loudness response curve when the audio signals are outputted, further bringing user a better sound quality in the current environment.

In practice, taking the television as an example, the specific implement step of the exemplary embodiment includes the following operations.

1. the television prestores n groups of single frequency sinusoidal signals with different frequencies, which are within the hearing range of the human ear (for example, there are five groups: 100 Hz, 500 Hz, 2 kHz, 8 kHz, 15 kHz; the more the groups of audio signals, the finer it is adjusted, the better the effect), each group of the signals is composed of signals whose amplitude values arranged from small to large, and defined as Fnj, the amplitude value is defined as Anj. The amplitude values having the same serial number in different groups are the same, such as, the amplitude value of the first signal F11 in the first group is the same with the amplitude value of the first signal F21 in the second group, that is A11=A21;

2. when finished booting for the first time, the interface would note user to finish the sound quality setting on site (one option can be set in the system setting, as such user can also adjust the sound quality at any time);

3. user can enter into the setting step through controlling the remote control: click on the first group of signals to play;

4. the system calls the first group of signals (such as 100 Hz) and makes a sound according to the amplitude values arranged from small to large from the speaker, the duration time of each signal is defined as t1, the interval time of each signal is defined as t2; if the pause signal has not been received from the user, the system would continuously play the signal behind the first group of the signals.

5. user listens the sound of the first group of signals at the conventional television watching position; as the previous amplitude values are smaller, the signals with small amplitude values are inaudible to human, with the amplitude values increase, user can gradually hear the sound; when heard the sound for the first time, user presses the pause button, for confirming the minimum signal amplitude;

6. after receiving the pause signal, the system remembers the serial number F1j of the signal ongoing (the serial number corresponds to an audio signal whose frequency has a given amplitude (the unit is V));

7. user can enter into the setting step: click on the second group of signals to play;

8. the system calls the second group of signals (such as 500 Hz) and makes a sound according to the amplitude values arranged from small to large from the speaker, the duration time of each signal is defined as t1, the interval time of each signal is defined as t2; if the pause signal has not been received from the user, the system would continuously play the signal behind the second group of the signals.

9. user listens the sound of the second group of signals at the conventional television watching position; as the previous amplitude values are smaller, the signals with small amplitude values are inaudible to human, with the amplitude values increase, user can gradually hear the sound; when heard the sound for the first time, user presses the pause button, for confirming the minimum signal amplitude;

10. after receiving the pause signal, the system remembers the serial number F2j of the signal ongoing (the serial number corresponds to an audio signal whose frequency has a given amplitude (the unit is V));

11. repeat steps 7-10 until the minimum signal amplitude values of the five groups of the signals which can be heard by user are acquired;

12. the signal amplitude of each group of signals which just can be heard by user is obtained according to serial number of each group of signals, and the needed compensating curve is calculated, referring to FIG. 2, the frequency response of the speaker is further compensated, to obtain the flat loudness response curve corresponding to the user, the environment, for resulting a more stereo sound quality effect, and, the quality factor is determined according to the group number of the signals, referring to Table 1.

Figure 6:
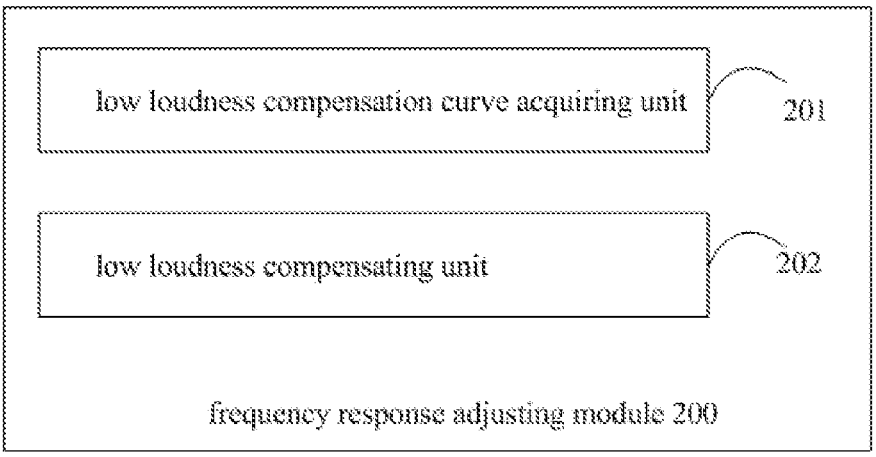
FIG. 6 is a functional module diagram of a device for compensating frequency response of audio signal of the present disclosure according to a second exemplary embodiment.

In the exemplary embodiment, through setting the multiple groups of audio signals having different frequencies, the minimum signal amplitude which can be heard by user is acquired, and the corresponding compensation gain is calculated accordingly, and the frequency response compensation curve of audio signal is generated, finally the audio signals can be adjusted according to the generated frequency response compensation curve of audio signal, and the adjusted audio signals can be outputted, as such the audio player is more aligned with the characteristic of human ear and the current environment in which the audio player is located, Furthermore, referring to FIG. 6, which shows a device for compensating frequency response of audio signal according to a second exemplary embodiment, based on the exemplary embodiment shown in FIG. 5, the frequency response adjusting module 200 includes:

a low loudness compensation curve acquiring unit 201, configured to acquire the section in the compensation curve which is lower than a preset frequency, to generate a low loudness compensation curve;

As when the audio player outputs the audio signals, the low loudness frequency response normally needs to be compensated, therefore the section in the compensation curve which is lower than a preset frequency is acquired, and the low loudness compensation curve is generated according to the acquired section, normally, the preset frequency is 600 Hz.

a low loudness compensating unit 202, configured to adjust an acoustic frequency response of the audio signal according to the low loudness compensation curve, and output the adjusted audio signal.

The acoustic frequency response of low frequency part of the audio signal is adjusted according to the low loudness compensation curve, and the adjusted audio signal is outputted, such outputting a flatter sound loudness response curve when the audio signals are outputted, further bringing user a better sound quality in the current environment.

In the exemplary embodiment, based on the advantages of the previous exemplary embodiment, the low frequency part of the audio signal is conducted with the frequency response compensation in the exemplary embodiment, which solves the problem of that the frequency response of the low frequency signal is not enough when outputting the audio signals.

Figure 7:
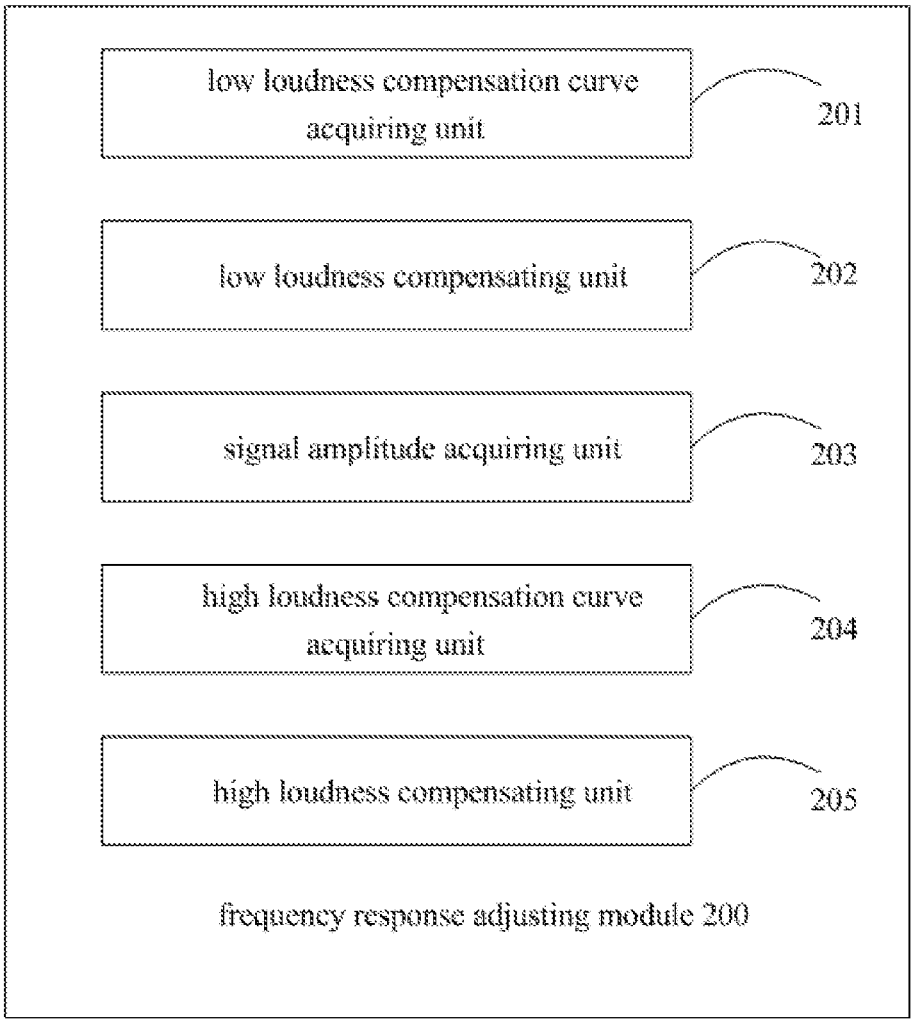
FIG. 7 is a functional module diagram of a device for compensating frequency response of audio signal of the present disclosure according to a third exemplary embodiment.

Furthermore, referring to FIG. 7, which shows a device for compensating frequency response of audio signal according to a third exemplary embodiment, based on the exemplary embodiment shown in FIG. 6, the frequency response adjusting module 200 further includes:

a signal amplitude acquiring unit 203, which is configured to acquire the root mean square value of the signal amplitude of the adjusted audio signal;

the adjusted audio signal, sampled in real time, the root mean square value of the adjusted signal amplitude is calculated according to the sampling result.

For this step, one possible embodiment includes:

1. each audio signal amplitude with a time period of T is sampled. For example, the sampling rate F is 48 k, and the number of sampling points is 48 k*T. Taking T=200 ms as an example, the number of sampling points=48 k*0.2=9600;

2. the root mean square e value of the signal with the starting point of t (that is the $t^{th}$ point, it amplitude is marked as F), the time period of T, is calculated in real time:

$$x = \frac{1}{F*T}\sqrt{\sum_{i=t+(F*T-1)}^{i=t} x_i^2}$$

a high loudness compensation curve acquiring unit 204, configured to acquire the section in the compensation curve which is higher than the preset frequency, to generate a high loudness compensation curve, when it is determined that the root mean square value of the signal amplitude is larger than a preset threshold value;

Whether the root mean square value of the signal amplitude is larger than the preset threshold value is determined, when the root mean square value of the signal amplitude is larger than the preset threshold value, the section in the compensation curve which is higher than the preset frequency is acquired, and the high loudness compensation curve is generated, commonly, the preset frequency is 600 Hz, in practice, a second order high pass filter can be adopted, the cutoff frequency of the second order high pass filter is the preset frequency.

a high loudness compensating unit 205, configured to adjust the acoustic frequency response of the audio signal according to the high loudness compensation curve, and output the adjusted audio signal.

The acoustic frequency response of high frequency part of the audio signal is adjusted according to the high loudness compensation curve, and the adjusted audio signal is outputted, such outputting a flatter sound loudness response curve when the audio signals are outputted, further bringing user a better sound quality in the current environment.

In the exemplary embodiment, based on the advantages of the previous exemplary embodiment, the low frequency part of the audio signal is conducted with the frequency response compensation in the exemplary embodiment, and the root mean square value of the signal amplitude of the compensated audio signal is determined at the same time, when it is bigger than the preset threshold value, the high frequency part of the audio signal is conducted with frequency response compensation, as such obtaining a flatter sound loudness response curve, further bringing user a better sound quality in the current environment.

The foregoing merely portrays some exemplary embodiments of this disclosure and therefore is not intended to limit the patentable scope of the disclosure. Under the inventive concept of this disclosure, any equivalent structural changes based on the specification and accompanying drawings of the disclosure and any direct/indirect applications of the disclosure on other related technical fields shall all be compassed within the patentable scope of protection of the present disclosure.

What is claimed is:

1. A method for compensating frequency response of audio signal, comprising:

presetting n groups of audio signals with different frequencies, acquiring the minimum signal amplitude value heard by user in each group of audio signals; the n groups of audio signals with different frequencies being n groups of single frequency sinusoidal signals with different frequencies, each group of audio signals being composed of single frequency sinusoidal signals whose amplitude values being arranged from small to large;

calculating by a preset gain algorithm to acquire corresponding compensation gain, according to the minimum signal amplitude value;

for each group of audio signals, calculating by a preset filtering coefficient algorithm to acquire a corresponding filtering coefficient, according to the frequency of the audio signal, the compensation gain, and a preset quality factor;

adjusting filter coefficient of corresponding filter, according to the filtering coefficient corresponding to the n groups of audio signals;

generating a frequency response compensation curve of audio signal according to a filter group which being composed of the n filters;

acquiring the section in the compensation curve which being lower than a preset frequency, to generate a low loudness compensation curve; and adjusting an acoustic frequency response of the audio signal according to the low loudness compensation curve, and outputting the adjusted audio signal.

2. The method according to claim 1, wherein after the step of adjusting the acoustic frequency response of the audio signal according to the low loudness compensation curve, and outputting the adjusted audio signal, the method further comprises:

acquiring the root mean square value of the signal amplitude of the adjusted audio signal;

when it is determined that the root mean square value of the signal amplitude is larger than a preset threshold value, acquiring the section in the compensation curve which is higher than the preset frequency to generate a high loudness compensation curve; and adjusting the acoustic frequency response of the audio signal according to the high loudness compensation curve, and outputting the adjusted audio signal.

3. A method for compensating frequency response of audio signal, comprising:

presetting n groups of audio signals with different frequencies, acquiring the minimum signal amplitude value heard by user in each group of audio signals;

calculating by a preset gain algorithm to acquire corresponding compensation gain, according to the minimum signal amplitude value;

for each group of audio signals, calculating by a preset filtering coefficient algorithm to acquire a corresponding filtering coefficient, according to the frequency of the audio signal, the compensation gain and a preset quality factor;

generating a frequency response compensation curve of audio signal according to the filtering coefficient corresponding to the n groups of audio signals; and adjusting an acoustic frequency response of the audio signal according to the compensation curve, and outputting the adjusted audio signal.

4. The method according to claim 3, wherein the n groups of audio signals with different frequencies are n groups of single frequency sinusoidal signals with different frequencies, each group of audio signals is composed of single frequency sinusoidal signals whose amplitude values are arranged from small to large.

5. The method according to claim 3, wherein the step of generating the frequency response compensation curve of audio signal according to the filtering coefficient corresponding to the n groups of audio signals comprises:

adjusting filter coefficient of corresponding filter, according to the filtering coefficient corresponding to the n groups of audio signals; and generating a frequency response compensation curve of audio signal according to a filter group composed of the n filters.

6. The method according to claim 3, wherein the step of adjusting the acoustic frequency response of the audio signal according to the compensation curve, and outputting the adjusted audio signal comprises:

acquiring the section in the compensation curve which is lower than a preset frequency, to generate a low loudness compensation curve; and adjusting the acoustic frequency response of the audio signal according to the low loudness compensation curve, and outputting the adjusted audio signal.

7. The method according to claim 6, wherein after the step of adjusting the acoustic frequency response of the audio signal according to the low loudness compensation curve, and outputting the adjusted audio signal, further comprises:

acquiring the root mean square value of the signal amplitude of the adjusted audio signal;

when it is determined that the root mean square value of the signal amplitude is larger than a preset threshold value, acquiring the section in the compensation curve which is higher than the preset frequency, to generate a high loudness compensation curve; and adjusting the acoustic frequency response of the audio signal according to the high loudness compensation curve, and outputting the adjusted audio signal.

8. A device for compensating frequency response of audio signal, comprising one or more processors and a non-transitory program storage medium storing program code executable by the one or more processors, the program code comprising:

a minimum amplitude acquiring module, configured to preset n groups of audio signals with different frequencies, and acquire the minimum signal amplitude value heard by user in each group of audio signals;

a compensation gain acquiring module, configured to calculate by a preset gain algorithm to acquire corresponding compensation gain, according to the minimum signal amplitude value;

a filtering coefficient acquiring module, configured to calculate by a preset filtering coefficient algorithm to acquire a corresponding filtering coefficient for each group of audio signals, according to the frequency of the audio signal, the compensation gain, and a preset quality factor;

a compensation curve generating module, configured to generate a frequency response compensation curve of audio signal according to the filtering coefficient corresponding to the n groups of audio signals; and a frequency response adjusting module, configured to adjust an acoustic frequency response of the audio signal according to the compensation curve, and output the adjusted audio signal.

9. The device according to claim 8, wherein the n groups of audio signals with different frequencies are n groups of single frequency sinusoidal signals with different frequencies, each group of audio signals is composed of single frequency sinusoidal signals whose amplitude values are arranged from small to large.

10. The device according to claim 8, wherein the compensation curve generating module comprises:

a filter adjusting unit, configured to adjust filter coefficient of corresponding filter, according to the filtering coefficient corresponding to the n groups of audio signals; and a filter group unit, configured to generate a frequency response compensation curve of audio signal according to a filter group composed of the n filters.

11. The device according to claim 8, wherein the frequency response adjusting module comprises:

a low loudness compensation curve acquiring unit, configured to acquire section in the compensation curve which is lower than a preset frequency, to generate a low loudness compensation curve; and a low loudness compensating unit, configured to adjust the acoustic frequency response of the audio signal according to the low loudness compensation curve, and output the adjusted audio signal.

12. The device according to claim 11, wherein the frequency response adjusting module further comprises:

a signal amplitude acquiring unit, configured to acquire the root mean square value of the signal amplitude of the adjusted audio signal;

a high loudness compensation curve acquiring unit, configured to acquire section in the compensation curve which is higher than the preset frequency, to generate a high loudness compensation curve, when it is determined that the root mean square value of the signal amplitude is larger than a preset threshold value; and a high loudness compensating unit, configured to adjust the acoustic frequency response of the audio signal according to the high loudness compensation curve, and output the adjusted audio signal.

13. The device according to claim 11, wherein the n groups of audio signals with different frequencies are n groups of single frequency sinusoidal signals with different frequencies, each group of audio signals is composed of single frequency sinusoidal signals whose amplitude values are arranged from small to large.

14. The device according to claim 11, wherein the compensation curve generating module comprises:

a filter adjusting unit, configured to adjust filter coefficient of corresponding filter, according to the filtering coefficient corresponding to the n groups of audio signals; and a filter group unit, configured to generate a frequency response compensation curve of audio signal according to a filter group composed of the n filters.

* * * * *